United States Patent [19]

Gemmani

[11] Patent Number: 4,484,607

[45] Date of Patent: Nov. 27, 1984

[54] SPLINTER PREVENTION DEVICE IN AUTOMATIC CYCLE WOODWORKING MACHINES

[75] Inventor: Giuseppe Gemmani, Rimini, Italy

[73] Assignee: SCM Finanziaria S.p.A., Rimini, Italy

[21] Appl. No.: 415,714

[22] Filed: Sep. 7, 1982

[30] Foreign Application Priority Data

Oct. 19, 1981 [IT] Italy ..... 3553 A/81

[51] Int. Cl.[3] ..... B27F 5/00

[52] U.S. Cl. ..... 144/82; 144/2 R; 144/84; 144/198 R; 144/356

[58] Field of Search ..... 144/2 R, 90 R, 90 A, 144/91, 67, 82, 83, 84, 198, 203, 204, 6, 133 R, 356

[56] References Cited

U.S. PATENT DOCUMENTS 3,927,705 12/1975 Cromeens et al. ..... 144/90 A

FOREIGN PATENT DOCUMENTS 2419938 4/1974 Fed. Rep. of Germany .
2840319 9/1978 Fed. Rep. of Germany .
3002226 1/1980 Fed. Rep. of Germany .
1052910 12/1966 United Kingdom .

*Primary Examiner*—W. D. Bray
*Attorney, Agent, or Firm*—Darby & Darby

[57] ABSTRACT

A device is fitted on automatic cycle woodworking machines and is able to protect the material subjected to machining against the danger of it splintering in the region of the outgoing edge of the tool.

The device consists of a movable element provided with a splinter preventing block and constituted by a carriage movable, in two directions, along the infeed path of the pieces to be machined. The carriage has connected to it an extension to which is secured a wood block that constitutes the splinter preventing means for the pieces to be machined, and this is able to rotate around a longitudinal axis along which the carriage traverses from a position away from the piece being machined to a position close thereto, the carriage and the extension being so controlled that the splinter prevention block is automatically positioned for the period of time needed for machining, on each piece to be handled, in the region of the outgoing edge of the tool with respect to the direction of rotation of this.

3 Claims, 4 Drawing Figures

SPLINTER PREVENTION DEVICE IN AUTOMATIC CYCLE WOODWORKING MACHINES

BACKGROUND OF THE INVENTION

The invention relates to an improved splinter prevention device in automatic cycle woodworking machines.

DESCRIPTION OF THE PRIOR ART

One problem that arises at the time wooden elements are being machined, for example during the tenoning operation when mortising tongues are cut at the end of wooden bars, is that the wood in the element being machined splinters in the region of the outgoing edge of the tool with respect to the direction of rotation thereof.

To overcome this machining fault which, in view of the characteristics of the wood, is inevitable, use is customarily made of what are called "splinter prevention devices". In other words a block, this too made of wood, of a shape exactly the same as that it is wished to give to the element being machined, is placed in the region of the outgoing edge of the tool from the element, and this allows the tool to pass but, at the same time, protects the edge of the element in question.

It is obvious that the need exists to use a number of splinter prevention devices identical to the number of different machining operations to be effected, although one and the same splinter prevention device can be utilized for a large number of machining operations that do not differ one from the other.

It is also obvious that, in the event of the use of automatic cycle machines provided with at least one infeed belt beneath a presser element, in between which the elements to be machined are locked and by which the latter are supplied, in a constant succession, to the machining groups placed along the path followed by the said belt, it is necessary to use a number of splinter prevention blocks in keeping with the operating pitch of the machine, fastened in a stable fashion to the underneath belt (or to the overhead presser element when this is constituted by an endless belt). This involves the use of automatic machines with a high rate of productivity which necessitate down times being considerably long when the tenon size-group has to be substituted, on account of the fact that the complete set of splinter prevention blocks has to be replaced with another set of a different format.

By way of an alternative to the foregoing problem, the problem can be solved by resorting to the use, for pieces of a certain length, of a pair of tools placed one downstream of the other and provided with profiles that are identical and coincident when machining. Given opposite directions of rotation, these alternate in contributing to the machining of the piece in the correct direction to avoid splintering. To be more precise, the first tool initiates the machining operation, after which it is automatically moved away and the second tool is inserted to perform the final "outgoing" part of the machining operation in the appropriate direction to ensure that splintering does not occur.

Although this method enables the piece to be machined perfectly without the danger of it splintering, the need to have a double set of tools has repercussions both of a financial and an operational nature, also because of the fact that the method in question is generally typical of high class automatic machines which are not, therefore, within the price range of small or medium sized firms.

With this object in view, applicant has recently developed a splinter prevention device suitable for automatic cycle machines of any type or class, that is able to exert an effect on the piece being machined solely at the point where the machining is taking place, and thus utilizes one single block per tenon profile.

More precisely, as also clearly described in Italian Patent Application No. 3434 A/81 in the name of the same Applicant as herein, the block is fastened to a pair of carriages movable, one with respect to the other, orthogonally along cartesian coordinates belonging to a vertical or horizontal plane, in such a way as to follow exactly the path of the piece being machined, and to do so purely for the period of time strictly necessary for the machining operation.

Alternatively, the block is rendered integral with an arm that oscillates around a vertical or horizontal axis, thereby uniting the two movements of causing the block to approach and be positioned, for the period of time needed for the machining operation to be executed, on the outgoing edge of the tool from the piece, with respect to the direction of rotation of the said tool.

Though with both of the solutions outlined above, the result obtained is extremely positive from a functional viewpoint, the volume of the complete machine employing the said device is adversely affected, particularly around the circumference of the tool, and this causes difficulty in making adjustments and regulations on the machine.

SUMMARY OF THE INVENTION

The essential object of the invention thus consists in overcoming the aforementioned problem through the construction of an improved splinter prevention device suitable for automatic cycle machines of any kind or class, that is able to exert an effect on the piece being machined solely at the point where the machining is taking place and thus, for each tenon profile, utilizes one single block of a limited volume, that is to say, of a volume such as not to affect excessively dimensions, maneuverability and accessiblity to the operating parts of the machine.

This and other objects too are all attained with the device according to the invention that can be fitted on automatic cycle woodworking machines constituted by at least one belt for infeeding the pieces to be machined, positioned beneath a presser element for locking the pieces, and provided with one or more machining assemblies placed in line along the path followed by the belt, as well as, furthermore, at least one splinter prevention block secured to the extremity of a movable element supported at one part of the machine, the movable element being subjected to operating means, interlocked to means for intercepting the pieces, provided to cause the block to approach and be positioned, for the period of time necessary for the machining operation, in the region of the outgoing edge of the tool from the piece, with respect to the direction of rotation of the tool, and being constituted by a carriage movable two ways along a first guide integral with one part of the machine, in a direction parallel to the direction in which the piece to be machined is infed; the carriage being provided with an extension for supporting the block and being subjected to operating means provided to rotate the block around an axis parallel to the infeed direction, between two extreme positions, namely a bottom position along the infeed direction of the extension, and an upper position in which the block is moved away from the path followed by the piece.

BRIEF DESCRIPTION OF THE DRAWINGS

Further characteristics and advantages of the device according to the invention will become more apparent from the description that follows of one form of embodiment, illustrated purely as an example on the accompanying drawings, in which.

DESCRIPTION OF THE PREFERRED EMBODIMENT

Figure 1:
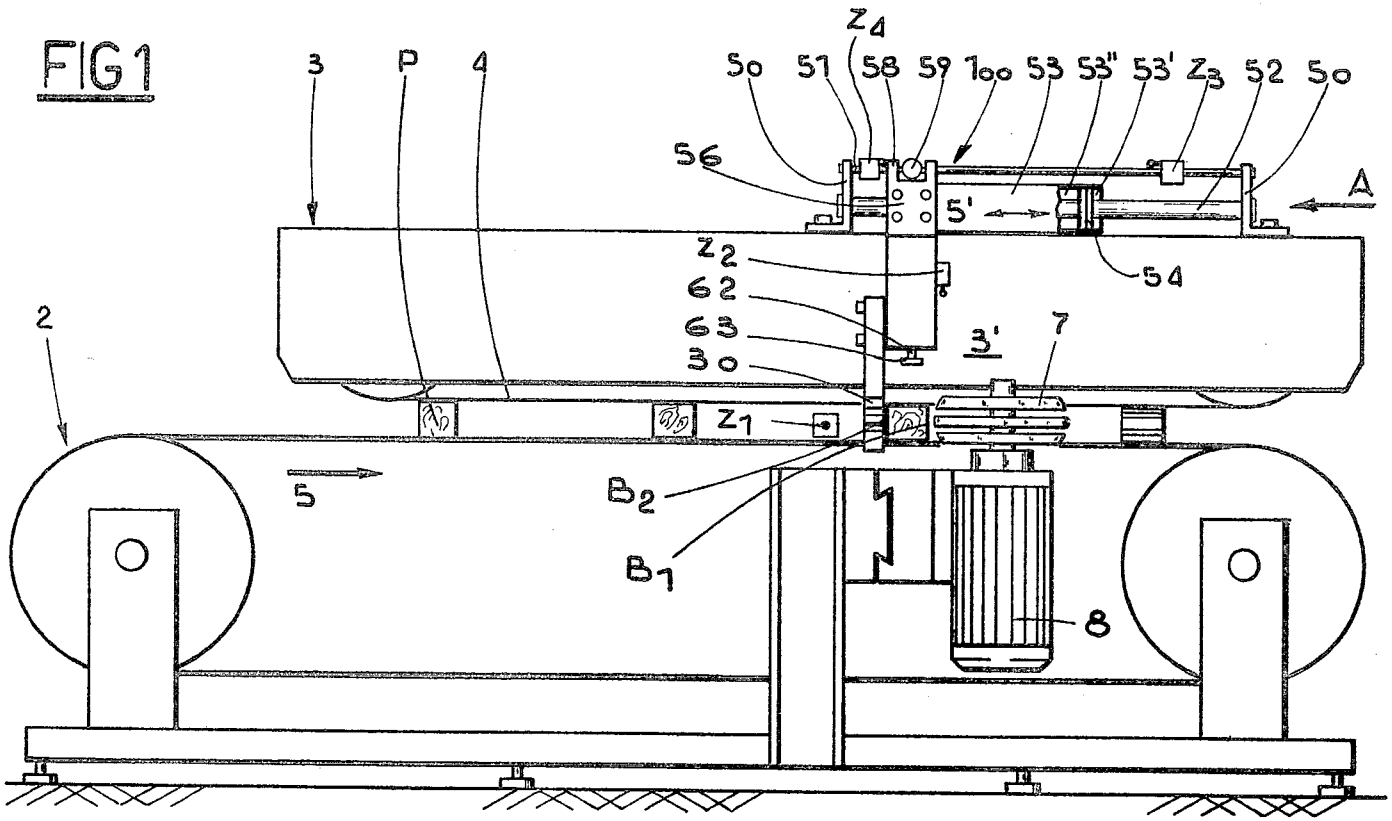
FIG. 1 shows, in a front diagrammatic view, the device in question mounted on an automatic cycle woodworking machine.

With reference to FIG. 1, the device shown generally at 100 is fitted on a woodworking machine of the automatic cycle type, constituted fundamentally by means for infeeding the pieces to be machined, shown at 2, defined by an endless belt, movable in the direction shown at 5 in FIG. 1, above which is placed, integral with the base frame with which the said belt 2 is also integral, a presser element 3 which, in the specific case described herein, is constituted by an ordinary driven belt 4, also endless, on which non-illustrated pressure means exert an effect vertically.

Figure 4:
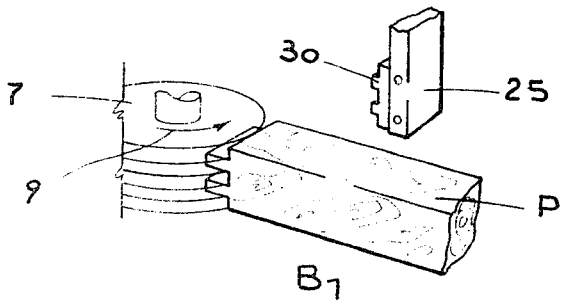
FIG. 4 shows, in a diagrammatic perspective view, the tool, the piece being machined and the splinter prevention block.

The pieces to be machined are shown at P, in the example given herein. The machining operation consists in the removal of material so as to obtain the configuration depicted in FIG. 4 so that two pieces can be locked one to the other. The pieces P are positioned manually or automatically on the belt 2 until the time when each piece is in the grasp of the aforementioned presser element, this representing the moment from which the infeeding of the piece to be machined to the subsequent operating assemblies is effected automatically.

In the case illustrated, the operating assembly is constituted by a vertical axis tool 7 fixedly mounted on the top of a motor 8 by which the former is carried in rotation in the direction shown at 9. The tool can obviously be positioned with respect to the piece to be machined suitably with the machining characteristics of the latter.

At the top of the machine illustrated, the device 100 is constituted by a pair of support elements 50 integral with the upper part of the presser element 3 and these, one opposite the other, sustain a pair of parallel guides 51 and 52 that are also parallel to the longitudinal direction in which the pieces are infed, shown at 5.

More precisely, the lower guide 52 is constituted by the rod of a pneumatic cylinder 53 able to slide, under the control of the air in the inside of two chambers 53' and 53'' separated one from the other by a head 54 integral with the guide rod 52, in the two directions shown at 5'.

Figure 2:
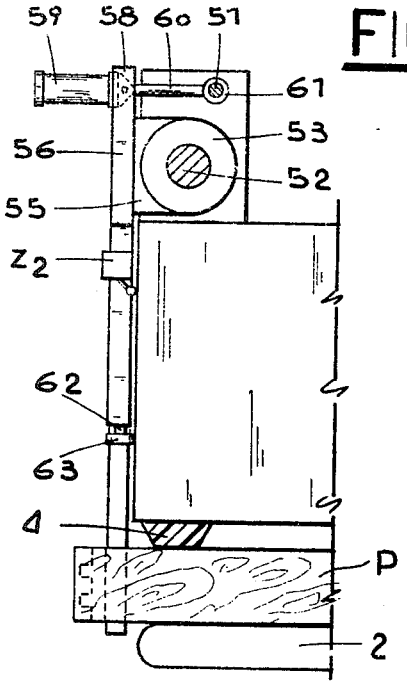

With reference also to FIG. 2, to the cylinder 53 is fixed externally (at the front when looking at FIG. 1), by means of a flange 55, a plate 56, the lower part of which is provided with a removable extension 25 that carries the splinter prevention block 30 and extends downwards to the height of the pieces P being machined.

Above the said plate 56, integral therewith, is placed a fork shaped element 58 (see FIG. 1) that carries, constrained by a horizontal pivot on an axis parallel to the said guides, a pneumatic cylinder 59 whose rod 60 is integral with a bush 61 that encompasses the upper guide 51 and slides there along subsequently to the sliding motion of the underneath cylinder 53.

Figure 3:
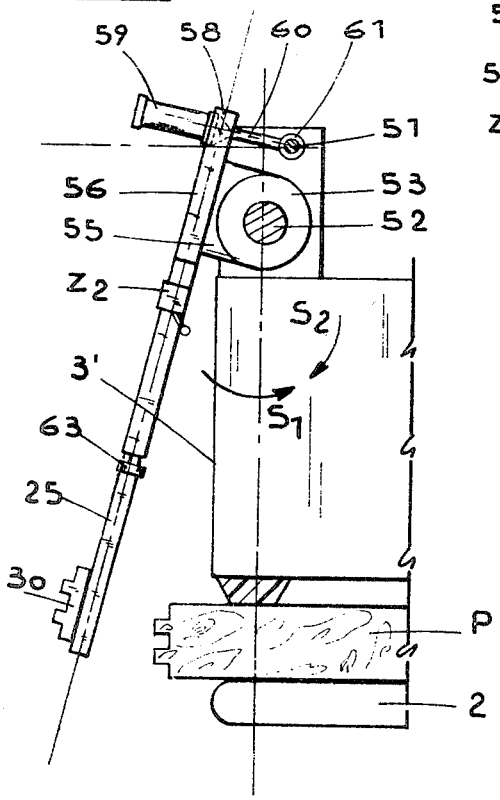
FIGS. 2 and 3 show, in a view from A in FIG. 1, the device in question in two configurations adopted by the splinter prevention block, namely the operating and the non-operating configuration.

The task of the cylinder 59 is to create a rotation of the group constituted by the cylinder 53, the plate 56, the extension 25 and the block 30 around the guide 52 between two extreme positions defined in FIGS. 2 and 3, namely with the block 30 in a first or vertical configuration, positioned along the path followed by the piece, to protect it (see FIG. 2), and with the block 30 in a second or oblique configuration, positioned away from the path followed by the piece to be machined, and thus in a non-operating condition (see FIG. 3).

In order to achieve the exact position depicted in FIG. 2, the lower part of the plate 56 is integral with a pin 62, provided with a vertical axis bearing 63, able to slide flush up against a corresponding datum surface which, in the described form of embodiment, can be constituted by the front surface 3' of the presser element 3.

The operation of the device illustrated is extremely simple: when a piece P about to be machined by the tool 7 reaches and trips a first microswitch $Z_1$, the cylinder 59 is actuated and this causes the displacement of the rod 60 and thus a rotation of the block 30 around the guide 52, in the counter clockwise direction $S_1$, from the position shown in FIG. 3 to that shown in FIG. 2, defined exactly by the bearing 63 abutting with the surface 3' of the presser element 3, which corresponds to the perfect alignment in a vertical direction of the block 30 with respect to the piece P, at the rear of the latter.

Once this configuration has been reached, the tripping of a second microswitch $Z_2$, for example on the part of the said presser element 3, causes air to be sent into the chamber 53' of the cylinder 53 and the consequential sideways travel of this and of the block 30 in the direction shown at 5 which, in this way, defines the approach motion of the block 30 until the block, during the movement thereof, arrives flush with the back of the outgoing side $B_2$ of the piece to be machined. The situation continues during the subsequent displacement of the piece P since the air under pressure in the inside of the chamber 53' keeps the block 30 constantly resting on the edge $B_2$, thanks to a pre-established regulation of the supply pressure, even while the tool 7 is carrying out the machining operation.

The block 30 is so positioned that the piece P being machined does not splinter either at the ingoing side $B_1$ of the tool, since the direction of rotation of the tool is favorable to splintering being avoided, or at the outgoing edge $B_2$, on the opposite side to $B_1$, in the region of which the piece being machined is protected by the said block 30, on which any possible splintering action is inflicted.

When the bush 61 reaches and trips a third microswitch $Z_3$ positioned along the guide 51 and thus adjustable in position, once the machining operation has taken place, air is inserted into the inside of the chamber 53'' and this causes the complete device to traverse in the opposite direction to that shown at 5 until it arrives at a non-operative position where, on the part of the bush 61, a fourth microswitch $Z_4$ is tripped, the latter causing the retraction of the rod 60 of the cylinder 59 and the rotation of the block 30 in the clockwise direction $S_2$ from the configuration shown in FIG. 2 to that shown in FIG. 3, pending a repetition of the above described complete cycle on the next piece P to be machined.

The advantage can thus clearly be seen that is derived from the use of a splinter prevention device of the type described herein, since a variation in the format of the piece to be machined necessitates purely the changing of just the block 30 on extension piece 25, the operation in question being one that takes very little time indeed, thereby rendering the machine extremely versatile and down times of a very limited duration. Above all, the great simplicity of the described solution enables the device to be of a very limited volume such as to virtually leave unchanged maintenance, tool changeover or other operations on the machine on which the device in question is mounted.

The device according to the invention can, in practical forms of embodiment, also differ constructionally from what has been outlined above and, in particular, numerous modifications of a practical nature may be introduced without in any way deviating from the framework of protection afforded to the invention.

What is claimed is:

1. An automatic cycle woodworking machine comprising:

at least one belt for feeding in a piece to be machined, presser means for pressing against said workpiece, rotating machining means for machining said workpiece when locked by said presser means, said rotating machining means making contact with said workpiece on an ingoing side of said piece and breaking contact with said workpiece on an outgoing side of said workpiece and having a direction of rotation such that it tends to cause splintering of said workpiece as it breaks contact therewith;

carriage means mounted for movement with respect to said machine back and forth in a direction parallel to the direction in which said workpiece is fed in;

an extension mounted on said carriage means for pivoting movement between first and second positions, said extension having an extremity which when said extension is in said first position is positioned in the path along which said workpiece is fed in and when said extension is in said second position is positioned in spaced-apart relation to said path;

a splinter prevention block mounted on said extremity; and operating means for causing said presser means to press against said workpiece, said extension to rotate from said second position to said first position and said carriage means then to press said block against said outgoing side of said workpiece, whereby said block supports said workpiece in such a manner as to prevent splintering thereof when said machining means breaks contact therewith.

2. A machine according to claim 1 wherein said carriage means comprises:

a first piston-cylinder means including a cylinder and a piston movable with respect to each other whereby to effect said back and forth movement of said carriage means; and second piston-cylinder means engagable with said extension and including a cylinder and a piston movable with respect to each other whereby to effect said pivoting movement of said extension.

3. Apparatus according to claim 1 further comprising locating means facilitating accurate positioning of said extension in said first position.

* * * * *